United States Patent [19]

Schubring

[11] Patent Number: 4,894,306

[45] Date of Patent: Jan. 16, 1990

[54] ION DEPOSITION PRINTING PAPER

[75] Inventor: H. Herbert Schubring, Island Pond, Vt.

[73] Assignee: James River Corporation of Virginia, Oakland, Calif.

[21] Appl. No.: 890,824

[22] Filed: Jul. 28, 1986

[51] Int. Cl.[4] ..... G03G 13/16

[52] U.S. Cl. ..... 430/126; 428/409; 101/462

[58] Field of Search ..... 430/126; 101/462; 346/159; 355/3 R, 3 T, 3 R; 428/409

[56] References Cited

U.S. PATENT DOCUMENTS

| | | | |
|---|---|---|---|
| 1,328,403 | 1/1920 | Shaw | 428/551 |
| 2,086,590 | 7/1937 | Whitehead | 464/106 |
| 2,561,353 | 7/1951 | Finne | 101/462 |
| 2,717,842 | 9/1955 | Vitalis | 428/551 |
| 2,717,877 | 9/1955 | Vitalis | 428/551 |
| 3,682,696 | 8/1972 | Yasuda | 428/551 |
| 4,241,161 | 12/1980 | Ensing | 430/126 |
| 4,415,626 | 11/1983 | Hasenauer et al. | 430/126 |
| 4,423,132 | 12/1983 | Kondo et al. | 430/126 |
| 4,619,515 | 10/1986 | Maczuszenko et al. | 355/3 SC |

*Primary Examiner*—John L. Goodrow

*Attorney, Agent, or Firm*—Stanley M. Teigland

[57] ABSTRACT

Paper employed in an ion deposition printing process can be made antistatic by incorporating into the paper a composition comprising a water-soluble electrolytic salt, such as sodium sulfate, and a water-miscible organic solvent having a high boiling point, such as glycerine. Being antistatic, the paper does not acquire stray charges of static electricity that interfere with the printing process.

4 Claims, No Drawings

ION DEPOSITION PRINTING PAPER

BACKGROUND OF THE INVENTION

This invention is an improved paper for ion deposition printing. In the ion deposition printing process, a digital signal is converted to an image in the form of an electrostatic charge which is transferred by ion deposition to a dielectric drum. The image is developed by a toner, which is fused to the paper. One problem associated with the process is that the paper, as it travels over carrier rolls before reaching the point of image transfer, tends to acquire stray electrostatic charges that adversely affect the quality of the developed image. Dehydration of the paper in the hot environment of the printer is believed to contribute to the generation of static electricity that is undesirably acquired by the paper.

SUMMARY OF THE INVENTION

The improved ion deposition printing paper of this invention contains an antistatic composition comprising a water-soluble electrolytic salt and a water-miscible organic solvent for the salt. The paper, which has a surface resistivity between about $10^9$ and $10^{12}$ ohms/cm$^2$, does not tend to acquire stray electrostatic charges, and therefore produces developed images of better quality.

DETAILED DESCRIPTION

The antistatic composition may conveniently be applied to the paper by combining it with the conventional surface sizing solution normally applied to printing paper. The sizing solution is preferably starch dissolved in water to a solids content of between about one and four percent by weight. The antistatic composition is added to the sizing solution in an amount which is sufficient to impart a surface resistivity between about $10^9$ and $10^{12}$ ohms/cm$^2$ to the finished paper. The resistivity is measured at 70° F. at fifty percent relative humidity on paper having a moisture content of five percent.

The amount of salt deposited on the paper is preferably between about 30 and 320 grams per ream, corresponding to between about 0.15 and 1.5 percent by weight of the paper. The amount of organic solvent deposited is preferably between about 15 and 150 grams per ream, corresponding to between about 0.07 and 0.7 percent by weight of the paper. The ratio of salt to solvent in the paper is preferably between about 5:1 and 1:1. The amount of surface size deposited on the paper is normally between about 0.8 and 1.2 grams per ream. The basis weight of the paper is normally about 46 pounds per ream. The sizing solution containing the antistatic composition is preferably applied to the paper by means of a size press. If desired, the antistatic composition may be applied to the paper, before or after sizing, by other means, such as by spraying or by a kiss roll.

The electrolytic salt is preferably an inorganic salt, such as aluminum nitrate, calcium chloride, magnesium chloride, or sodium sulfate. Sodium sulfate is preferred.

The organic solvent has a high boiling point, preferably greater than about 190° C., more preferably greater than about 250° C. Suitable solvents include glycerine, polyethylene glycol, the amides, amines, esters, alkylamides, and alkylamines of polyethylene glycol, polyacrylamide, polyacrylic acid, and hydrolyzed polyvinyl acetate, including polyvinyl alcohol. Glycerine is preferred.

The salt and the organic solvent are preferably both hygroscopic.

EXAMPLES 1–4

A sizing solution was prepared by dissolving 3.5 parts of cooked starch in 100 parts of water. Sodium sulfate (salt cake) and glycerine were added to the solution in the amounts shown below.

EXAMPLE

| | 1 | 2 | 3 | 4 |
|---|---|---|---|---|
| Sodium Sulfate, weight percent | 0.14 | 0.29 | 0.6 | 1.5 |
| Glycerine, weight percent | 0.07 | 0.17 | 0.3 | 0.7 |

The solutions were applied by means of a size press to paper having a basis weight of 46 pounds per ream. The paper was dried at about 190° C. in accordance with conventional methods. The amount of sodium sulfate and glycerine deposited on the dried paper, and the surface resistivity of the finished paper, are shown below.

EXAMPLE

| | Control | 1 | 2 | 3 | 4 |
|---|---|---|---|---|---|
| Sodium Sulfate, g/ream | 0 | 31.5 | 61.0 | 120.0 | 315.0 |
| Glycerine, g/ream | 0 | 15.75 | 35.0 | 65.0 | 140.0 |
| Resistivity, ohms/cm$^2$ | $10^{14}$ | $10^{12}$ | $10^{11}$ | $10^{10}$ | $10^9$ |

The papers of Examples 1–4 were used in an ion deposition printer with excellent results. The high temperatures encountered in the printer did not degrade the paper, as might have been expected.

I claim:

1. In the ion deposition printing process wherein a digital signal is converted to an image in the form of an electrostatic charge which is transferred by ion deposition to a dielectric drum, and the image is developed by a toner which is fused to a sheet of paper, the improvement wherein the paper contains an antistatic composition comprising a water-soluble electrolytic salt and water-miscible organic solvent for the salt, the solvent having a boiling point greater than about 190° C., and the paper having a surface resistivity between about $10^9$ and $10^{12}$ ohms/cm$^2$.

2. The improvement of claim 1 wherein the paper contains between about 0.15 and 1.5 percent by weight of the salt and between about 0.07 and 0.7 percent by weight of the solvent.

3. The improvement of claim 1 wherein the paper has a surface sizing of starch and the improvement includes incorporating the antistatic composition in the sizing.

4. The improvement of claim 1 wherein the salt is sodium sulfate and the organic solvent is glycerine.

* * * * *